US011773551B2

(12) United States Patent
Kueper

(10) Patent No.: US 11,773,551 B2
(45) **Date of Patent: *Oct. 3, 2023**

(54) CLEARING STRIP FOR USE AT HIGH SPEEDS AND FOR LONG CLEARING STRETCHES

(71) Applicant: Kueper GmbH & Co. KG, Bochum (DE)

(72) Inventor: Roland Kueper, Bochum (DE)

(73) Assignee: Kueper GmbH & Co. KG, Bochum (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/859,642

(22) Filed: Jul. 7, 2022

(65) Prior Publication Data

US 2022/0341110 A1 Oct. 27, 2022

Related U.S. Application Data

(63) Continuation of application No. 16/322,676, filed as application No. PCT/EP2017/069836 on Aug. 4, 2017, now Pat. No. 11,414,823.

(30) Foreign Application Priority Data

Aug. 4, 2016 (DE) ..... 10 2016 114 457.6

(51) Int. Cl.
*E01H 5/06* (2006.01)

(52) U.S. Cl.
CPC ..... *E01H 5/062* (2013.01)

(58) Field of Classification Search
CPC . E01H 5/06; E01H 5/062; E01H 5/065; E02F 3/8152
See application file for complete search history.

(56) References Cited

U.S. PATENT DOCUMENTS

| | | | |
|---|---|---|---|
| 4,288,932 | A | 9/1981 | Kueper |
| 4,347,677 | A | 9/1982 | Kueper |
| 7,631,441 | B2 | 12/2009 | Hunt |
| 7,765,726 | B2 | 8/2010 | Kueper |

(Continued)

FOREIGN PATENT DOCUMENTS

| | | |
|---|---|---|
| DE | 29 04 251 A1 | 8/1980 |
| DE | 33 19 223 A1 | 7/1984 |

(Continued)

OTHER PUBLICATIONS

International Search Report of PCT/EP2017/069836, dated Oct. 16, 2017.

*Primary Examiner* — Jamie L McGowan
(74) *Attorney, Agent, or Firm* — Collard & Roe, P.C.

(57) ABSTRACT

A clearing strip for the clearing shield of a snow plow has a front steel plate and a rear steel plate between which an elastic rubber layer with at least one hard material body embedded in the rubber compound thereof is incorporated by vulcanization. The hard material body is movable relative to the steel plates with elastic deformation of the rubber compound. To better secure the hard material bodies embedded in the rubber compound against uncontrolled fall-out from the clearing strip upon overheating, each individual hard material body is anchored within the clearing strip by an additional anchoring device that does not limit the movability of the hard material bodies relative to the steel plates.

2 Claims, 8 Drawing Sheets

(56) References Cited

U.S. PATENT DOCUMENTS

| | | | |
|---|---|---|---|
| 7,905,035 | B2 | 3/2011 | Thomas |
| 8,640,365 | B2 | 2/2014 | Kueper |
| 9,428,874 | B2 | 8/2016 | Winter et al. |
| 9,562,342 | B2 | 2/2017 | Winter et al. |
| 10,947,686 | B2 | 3/2021 | Kueper |
| 2001/0005949 | A1 | 7/2001 | Amano et al. |
| 2006/0070264 | A1 | 4/2006 | Lachance et al. |
| 2007/0107272 | A1 | 5/2007 | Weagley et al. |
| 2009/0223090 | A1 | 9/2009 | Hunt |
| 2013/0212915 | A1 | 8/2013 | Abramczyk et al. |
| 2014/0259805 | A1 | 9/2014 | Fox et al. |
| 2016/0069041 | A1 | 3/2016 | Winter et al. |
| 2016/0354811 | A1 | 12/2016 | Zwerner et al. |
| 2017/0191236 | A1 | 7/2017 | Winter |
| 2018/0327989 | A1 | 11/2018 | Stephan |
| 2021/0332542 | A1 | 10/2021 | Kueper |

FOREIGN PATENT DOCUMENTS

| | | | |
|---|---|---|---|
| DE | 33 47 784 | A1 | 5/1985 |
| DE | 10 2005 040 705 | A1 | 3/2007 |
| DE | 20 2007 018113 | U1 | 4/2008 |
| DE | 10 2016 114 457 | A1 | 2/2018 |
| EP | 2 933 378 | A1 | 10/2015 |
| WO | 2006/052196 | A1 | 5/2006 |

CLEARING STRIP FOR USE AT HIGH SPEEDS AND FOR LONG CLEARING STRETCHES

CROSS REFERENCE TO RELATED APPLICATIONS

This application is a continuation of and Applicants claim priority under 35 U.S.C. § 120 of U.S. application Ser. No. 16/322,676 filed on Feb. 1, 2019, which application is a national stage application under 35 U.S.C. § 371 of PCT Application No. PCT/EP2017/069836 filed on Aug. 4, 2017, which claims priority under 35 U.S.C. § 119 from German Patent Application No. 10 2016 114 457.6 filed on Aug. 4, 2016, the disclosures of each of which are hereby incorporated by reference. A certified copy of priority German Patent Application No. 10 2016 114 457.6 is contained in parent U.S. application Ser. No. 16/322,676. The International Application under PCT article 21(2) was not published in English.

BACKGROUND OF THE INVENTION

1. Field of the Invention

The invention relates to a clearing strip for the clearing shield of a snow plow, which strip has a front steel plate and a rear steel plate, between which an elastic rubber layer having at least one hard-material body embedded into the rubber compound is vulcanized in, wherein the hard-material body is movable relative to the steel plates, with elastic deformation of the rubber compound.

2. Description of the Related Art

Such a clearing strip is known, for example, from DE 10 2005 040 705 A1 of the applicant. In use, these clearing strips have proven themselves extraordinarily well. Because of the different layers of steel, rubber, and hard material, they are extremely wear-resistant. Because the hard-material bodies are embedded in the elastic rubber layer, they can move back during impacts caused by uneven areas in the road surface, and are not damaged.

When using such clearing strips, it becomes increasingly important that they can be used with as little interruption as possible at relatively high speeds of the snow-clearing vehicles. Because of the high speed and the simultaneous absence of interruptions, the clearing strips become hot due to friction heat. In particular in the case of snow clearing down to the road surface, which is generally required, during which process constant contact exists between the clearing strip and the road surface, the friction heat that occurs is significant. In this regard, the hard-material bodies that are embedded in the rubber compound heat up particularly greatly, because the rubber compound fundamentally has poor heat conductivity and the friction heat introduced into the hard-material bodies cannot be conducted away or can only be conducted away poorly by means of heat conduction. In the most disadvantageous case, under extraordinarily great stress, the hard-material bodies embedded in the rubber compound can heat up greatly in the region of the lower wear surface, and this has the result that the rubber compound becomes brittle in the regions directly adjacent to the hard-material bodies and/or that the connection between rubber and hard-material body, achieved by means of adhesives, is dissolved, so that the hard-material bodies are no longer anchored in the rubber compound with sufficient security, and the danger exists that the road traffic that follows the snow plow is at risk from hard-material bodies falling out.

In order to counteract these overheating phenomena, DE 10 200 040 705 A1 proposes cooling devices in the form of openings above the wear region of the clearing strip, by way of which openings the interior of the clearing strip is cooled with snow that penetrates into these openings from the front during the clearing process. With this measure, good effects against overheating have already been achieved.

Nevertheless, however, the risk of overheating cannot be entirely precluded even with such cooling devices, for example if too little snow is present for cooling purposes on the road to be cleared, or if the cooling devices become clogged or become incapable of functioning for some other reason. Therefore, it continues to be impossible to reliably preclude that the hard-material bodies fall out of the rubber compound during clearing work, due to overheating, and endanger the road traffic that follows the snow plow.

In DE 33 47 784 A1, a similar clearing strip is disclosed. The clearing strip described there has a wear rail partially embedded into the rubber body, which rail projects far downward beyond the lower edges of the two steel plates. This wear rail is constantly exposed to extreme momentum during the clearing process, which force attempts to turn the wear rail out of the rubber compound that holds it. For better fixation of the wear rail, additional securing pins are also provided there, which are passed through the front steel plate, the wear rail, and the rear steel plate. However, due to this additional attachment, the wear rail loses its movability relative to the other components of the clearing strip. As a result of this rigid attachment of the wear rail, shear stresses occur during clearing work, in the region of the securing pins, which stresses shear these securing pins off and thereby make them unusable. Therefore it is not possible to prevent the wear rail from falling out of the clearing strip in uncontrolled manner, with sufficient reliability, even with such securing pins.

SUMMARY OF THE INVENTION

It is the task of the invention to further develop the clearing strip of the type mentioned initially to the effect that the hard-material bodies embedded in the rubber compound are secured to prevent them from falling out of the clearing strip in uncontrolled manner in the case of overheating.

To accomplish this task, the invention proposes, proceeding from the clearing strip of the type mentioned initially, that each individual hard-material body is anchored in the interior of the clearing strip by means of an additional anchoring apparatus, wherein this additional anchoring apparatus does not restrict the movability of the hard-material bodies relative to the steel plates.

By way of such an attachment apparatus, it is ensured that the hard-material bodies do not fall out of the clearing strip even if the rubber compound becomes brittle at the boundary surface to the hard-material bodies due to overheating and/or if the connection between rubber and hard-material body achieved using adhesives is dissolved. The hard-material bodies nevertheless continue to be able to move back into the elastic rubber layer in the event of impacts caused by uneven areas of the road, since they remain movable relative to the front and rear steel plate, without they themselves or the anchoring apparatus being destroyed.

It is particularly advantageous if the anchoring apparatus consists of a heat-resistant material. By means of this measure, it is guaranteed that the anchoring apparatus is not damaged due to heating of the clearing strip. Depending on where the anchoring apparatus is provided, it is exposed to heat stress. This heat stress is greater, of course, in the vicinity of the lower wear edge than in the region that lies further upward.

Furthermore, it is practical if the anchoring apparatus is embedded, at least in part, in the rubber layer above the hard-material bodies. The rubber layer above the hard-material bodies does not heat up as greatly during use, since it is relatively far away from the wear edge. Accordingly, it is not at risk of becoming brittle here. In this manner, the anchoring apparatus and thereby also the hard-material bodies remain movable with regard to the front and rear steel plate.

It is furthermore advantageous if the anchoring apparatus has at least one anchoring element that is passed through the hard-material body. As a result, the hard-material body is securely held in the clearing strip, even if the rubber compound at the boundary surface to the hard-material body becomes brittle in the lower region.

A preferred embodiment of the clearing strip provides that the anchoring element is structured as a woven aramid tape. Woven aramid textiles are characterized by particularly great tear strength and temperature resistance. For this reason, it is almost impossible for the hard-material bodies to fall out of the rubber layer. The hard-material bodies furthermore remain movable in the rubber layer due to the additional attachment by means of woven aramid tape, so that they continue to be able to absorb impacts caused by uneven areas on the surface to be cleared, in that they move back into the elastic rubber layer.

Furthermore, it is advantageous if the woven aramid tape is additionally attached between the front and rear steel plate, in the upper region, with force fit. Because of this additional force-fit connection, the anchoring apparatus is even more secure.

An alternative embodiment provides that the anchoring element is structured as a steel tape. As an alternative to a woven aramid tape, the steel tape is characterized, in particular, by its advantageous price at sufficient tear strength and temperature resistance.

As also in the case of the woven aramid tape, it is advantageous if the steel tape is additionally attached with force fit in the upper region between the front and rear steel plate. Because of this additional force-fit connection the anchoring apparatus is even more secure.

A further alternative possibility provides that the anchoring element is structured as a wire cable. A wire cable has similar properties with regard to tear strength and temperature resistance as the steel tape mentioned above. Because of the structured surface of the wire cable, however, the connection to the rubber layer is stronger, due to the greater surface area, than in the case of a steel tape, which tends to be flat at its surface.

Also in the case of an embodiment with a wire cable, it is particularly advantageous if the wire cable is additionally attached with force fit in an upper region between the front and rear steel plate. Because of the clamping process, the cross-section of the wire cable is deformed and adapts to the surfaces of the steel plates, so that the adhesion friction of the connection is further reinforced.

Another alternative embodiment provides that the anchoring element is structured as a hook. Such a hook can consist of steel, for example. In that the hook is embedded into the rubber body above the hard-material body, the hard-material body cannot fall out, but it can continue to absorb impacts caused by uneven areas on the road surface, since the rubber compound above the hard-material body does not lose elasticity.

In addition, it is practical if, in the case of the aforementioned alternative embodiments, the passage through the hard-material body has play with reference to the anchoring element. In this way, it is prevented that the anchoring element is subject to stress caused by material friction.

A further anchoring apparatus provides for at least one bolt that is attached, with play, through the hard-material body (6) and rigidly on the rear and/or front steel plate (2, 4). In this manner, a shape-fit connection is produced between the hard-material body and the two steel plates. The hard-material body is held in the clearing strip by means of the bolt, but remains movable relative to the respective steel plate that serves for attachment, due to the play with which it is passed through.

A further variant of the anchoring apparatus has at least one bolt that is rigidly connected with the hard-material body and passed, with play, through the rear and/or the front steel plate (2, 4). Here, too, the hard-material body remains movable due to the play of the bolt when it is passed through the respective steel plate.

As an alternative to the aforementioned embodiments, it is practical if at least one anchoring element is welded on at the upper end of the hard-material body, so that the hard-material body, with anchoring element welded onto it, is better anchored in the rubber layer. The hard-material body is no longer at risk of breaking out. At the same time, the hard-material body regains its movability with regard to the rest of the clearing strip, since the rubber compound above the hard-material body does not become as hot as in the vicinity of the wear surface, and therefore does not become brittle. Here, a helical spring or a bracket, for example, can serve as a welded-on attachment element, since their shapes bring a good anchoring effect with them after the vulcanization process.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1B:
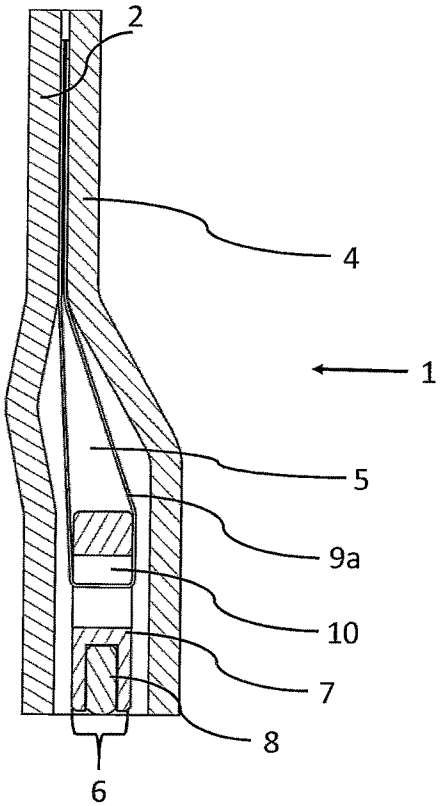
FIG. 1*b* shows schematically, a cross-section through the clearing strip from FIG. 1*a;*

In the drawings, a clearing strip is indicated with the reference symbol 1. The clearing strip 1 has a front steel plate 2 having multiple bores 3 in the upper region, and a rear steel plate 4, also having bores 3 in the upper region. The front and rear steel plate 2, 4 can be connected by means of a screw connection, not shown, through the bores 3, and attached to a clearing shield, also not shown, of a snow plow. An elastic rubber layer 5 is vulcanized on between the two steel plates 2 and 4. A hard-rubber body 6 is embedded into the elastic rubber layer 5. Here, this hard-material body 6 has a tungsten carbide core 8 surrounded by a steel mantle 7.

In practice, it has been shown that a clearing strip 1 structured in this way is far superior to conventional clearing strips with regard to its useful lifetime and its robustness. Due to the rubber layer 5 that surrounds the hard-material bodies 6, these can move back into the rubber layer in the case of impacts caused by uneven areas on the surface to be cleared, and are therefore not damaged by these impacts. However, due to the demands with regard to clearing speed and uninterrupted use of the clearing strips 1, which demands are becoming ever greater, the strips become increasingly hot. At their wear surface at the lower end, in particular, very high temperatures occur due to friction heat. This can lead to the result that the hard-material bodies are heated to red heat. Since the rubber layer 5 can only conduct this heat away poorly, it is at risk of becoming brittle at the boundary layer to the hard-material body, in particular in the lower region, and/or the connection between rubber and hard-material body, which was achieved by means of adhesives, is at risk of dissolving. Consequently, secure hold of the hard-material bodies 6 due to their embedding in the rubber layer 5 is no longer guaranteed. The hard-material bodies can fall out of the clearing strip 1 in uncontrolled manner, and thereby cause damage to the snow plow, but also represent a hazard for the traffic following the snow plow.

For this reason, additional anchoring of the hard-material bodies 6 in the clearing strip 1 is necessary. In this regard, however, the additional anchoring must guarantee the movability of the hard-material body 6 in the elastic rubber layer 5, and is not allowed to significantly restrict it. This means that the hard-material body 6 must continue to be able to move back in the case of impacts caused by uneven areas on the surface to be cleared.

Such additional anchoring can be implemented in different ways. Possible embodiments are shown in the drawing.

Figure 1A:
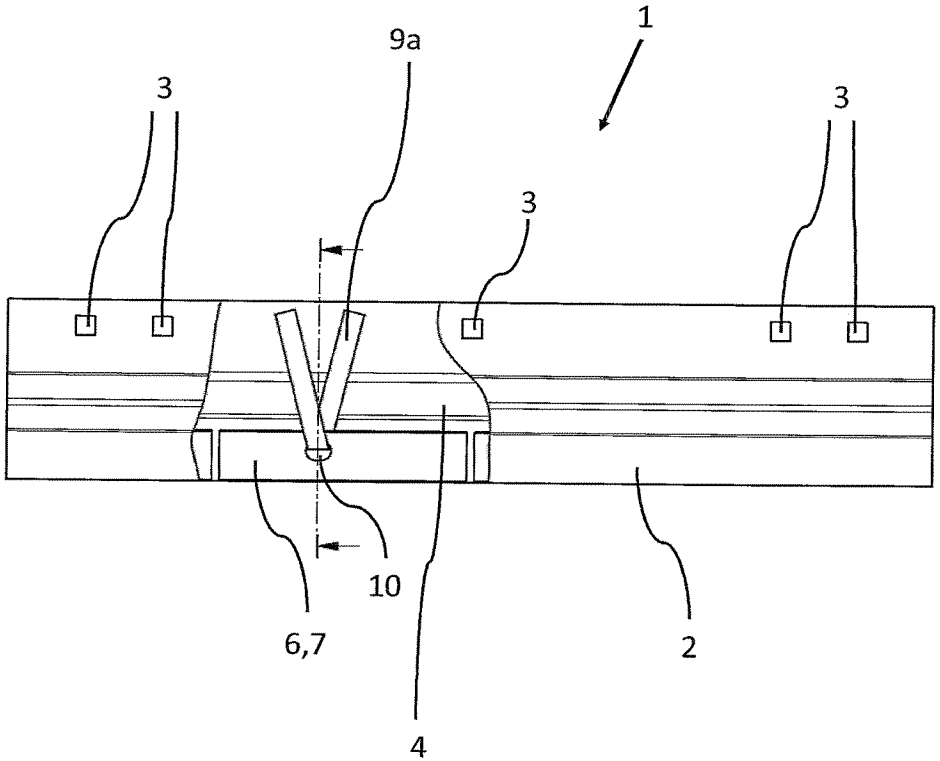
FIG. 1*a*: shows schematically, the front view of a clearing strip according to the invention, using a first exemplary embodiment.

In FIG. 1*a/b*, the additional anchoring is implemented by means of a woven aramid tape 9*a*. The woven aramid tape 9*a* is passed through a bore 10 through the hard-material body 5. The ends of the woven aramid tape 9*a* are clamped in place in the upper region of the clearing strip 1, between the front and rear steel plate 2, 4, and are thereby connected with the two steel plates with force fit. Furthermore, the woven aramid tape 9*a* is vulcanized into the rubber layer. The woven aramid tape 9*a* is not laid tightly through the rubber layer 5 and the hard-material body 6, so that the hard-material body 6 remains movable in the rubber layer 5. Furthermore, the bore 10 has play with regard to the cross-section of the woven aramid tape 9*a*, so as to additionally guarantee the movability of the hard-material body 6 in this way, too. Furthermore, the woven aramid tape 9*a* is also not additionally damaged due to friction on the hard-material body 6.

Figure 2B:
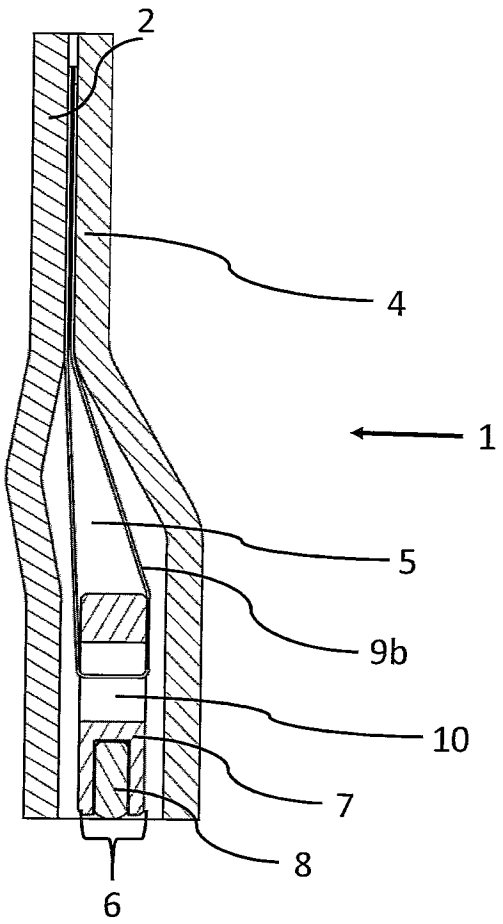
FIG. 2*b* shows schematically, a cross-section through the clearing strip from FIG. 2*a;*
Figure 2A:
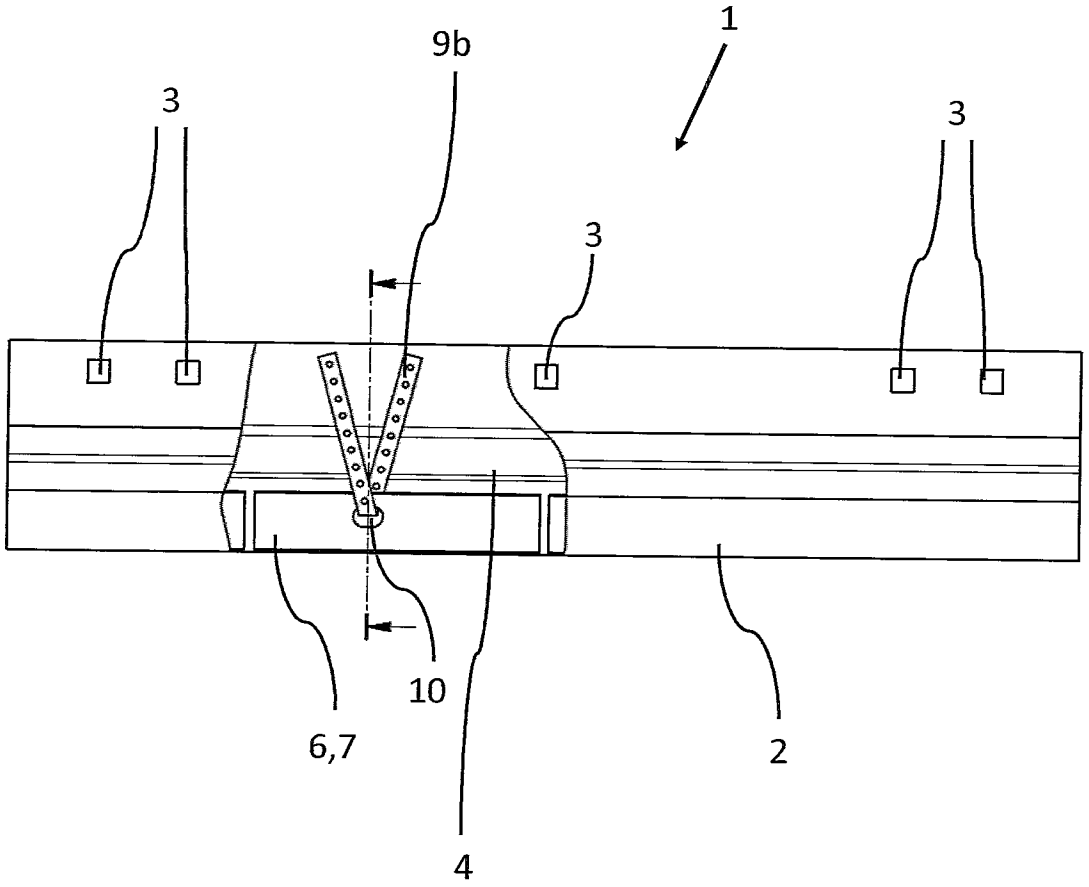
FIG. 2*a* shows schematically, the front view of a clearing strip according to the invention, using a second exemplary embodiment.

In FIG. 2*a/b*, a steel tape 9*b* is provided in place of the woven aramid tape 9*a* for anchoring of the hard-material body 6. The ends of the steel tape 9*b* are also clamped in place in the upper region, between the front and rear steel plate 2, 4, and vulcanized into the rubber layer 5, so that the steel tape 9*b*, as described above, also holds the hard-material body 6 in the clearing strip 1 in secure and movable manner.

Figure 3B:
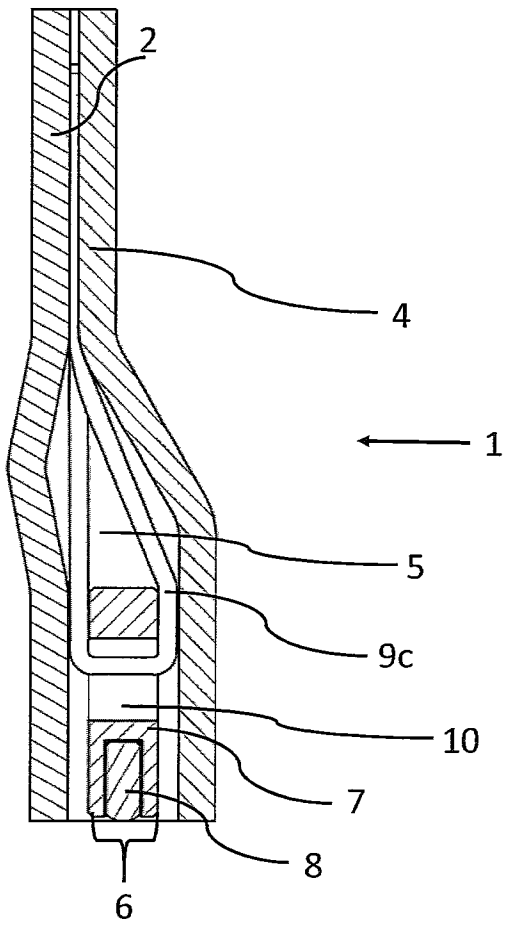
FIG. 3*b* shows schematically, a cross-section through the clearing strip from FIG. 3*a;*
Figure 3A:
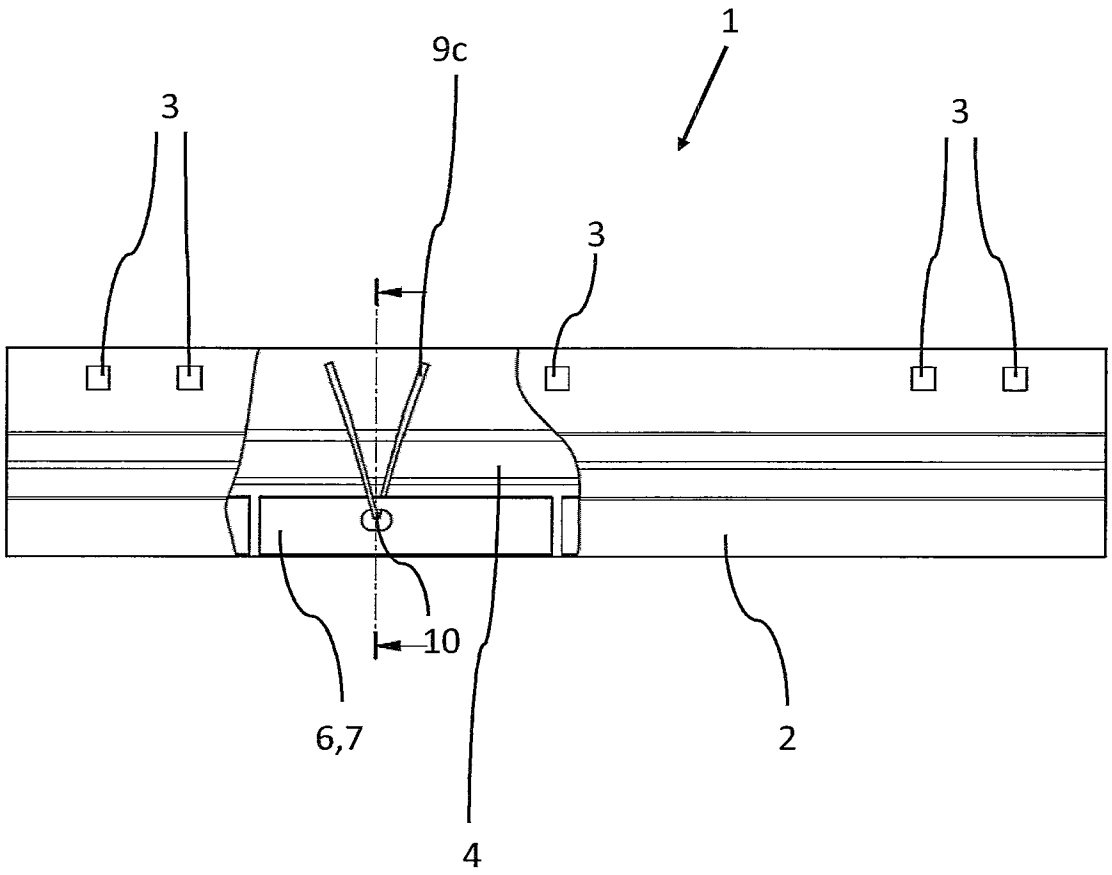
FIG. 3*a* shows schematically, the front view of a clearing strip according to the invention, using a third exemplary embodiment.

In FIG. 3*a/b*, the anchoring apparatus of the hard-material body 6 is provided by means of a wire cable 9*c*. Anchoring of the hard-material body 6 takes place here in the same way as in the case of the two embodiments mentioned above. In this embodiment, the cross-section at the ends of the wire cable 9*c* is deformed due to being clamped in place between the two steel plates 2, 4. As a result, the surface of the wire cable 9*c* adapts to the surface of the two steel plates 2, 4 in this region, and the force fit is reinforced in this way.

Figure 4B:
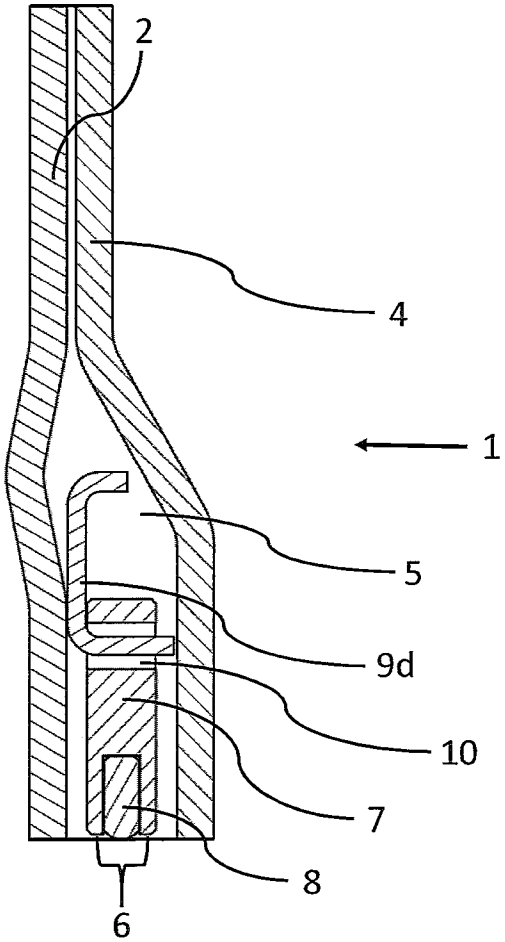
FIG. 4*b* shows schematically, a cross-section through the clearing strip from FIG. 4*a;*
Figure 4A:
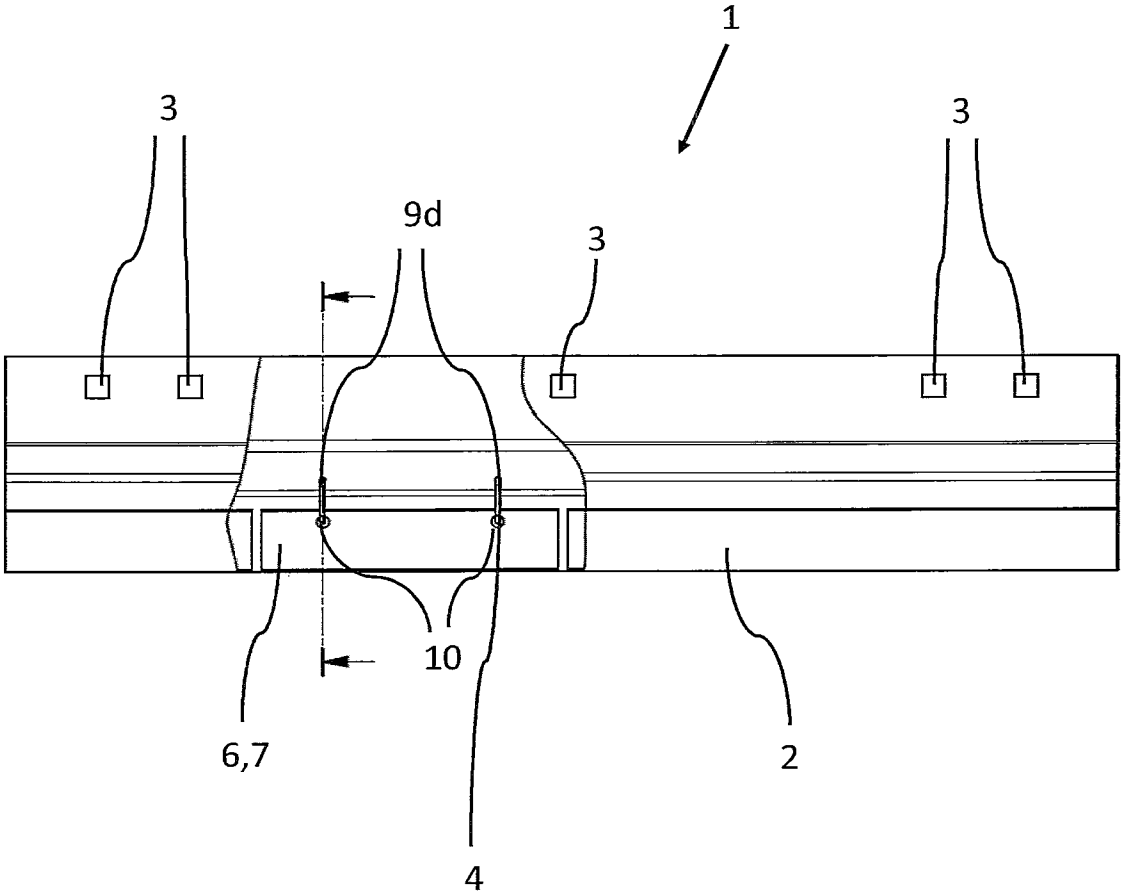
FIG. 4*a* shows schematically, the front view of a clearing strip according to the invention, using a fourth exemplary embodiment.

In FIG. 4*a/b*, two bent hooks 9*d* are passed through the bores 10 of the hard-material body 6. The bent hooks 9*d* hold the hard-material body 6 in the clearing strip 1 with shape fit, in the region above the hard-material body 6, due to the bent shape. In this regard, the hard-material body 6 retains its movability relative to the remainder of the clearing strip. It would also be possible that the bent hooks 9*d* are brought together to form a loop above the hard-material body 6. The bent hooks 9*d* can be made of aramid or steel, but other materials are also possible.

Figure 5B:
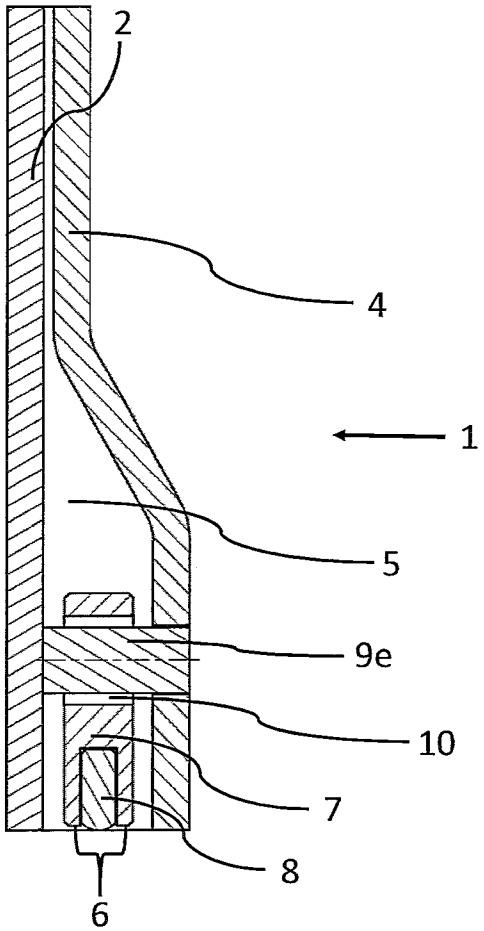
FIG. 5*b* shows schematically, a cross-section through the clearing strip from FIG. 5*a;*
Figure 5A:
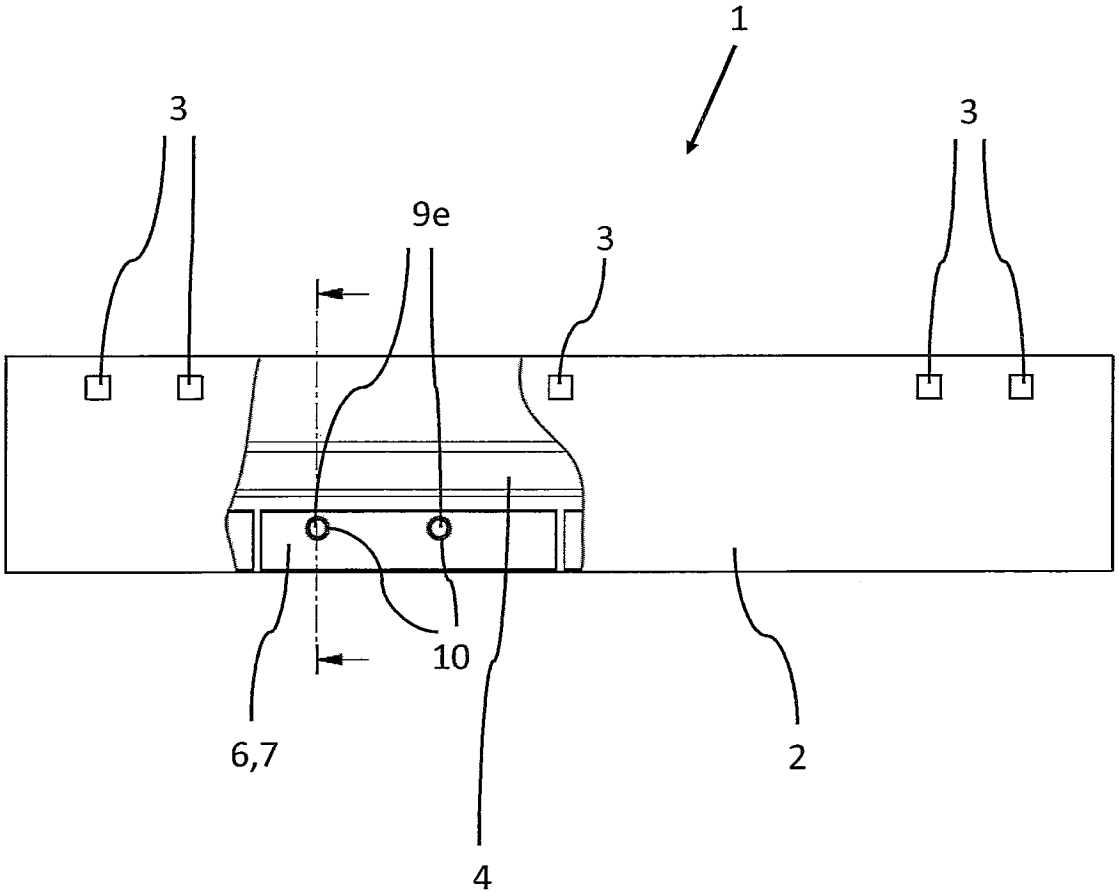
FIG. 5*a* shows schematically, the front view of a clearing strip according to the invention, using a fifth exemplary embodiment.

In FIG. 5*a/b*, an embodiment is shown in which anchoring of the hard-material body 6 in the clearing strip 1 is implemented by means of a bolt 9*e*. The bolt is passed through the hard-material body 6 with play and through the rear steel plate 4 with precise fit. Due to the geometry of the bolt 9*e* and of the elements of the clearing strip 1, a shape-fit connection is produced, by means of which the hard-material body 6 is held in the clearing strip in secure and simultaneously movable manner.

Figure 6B:
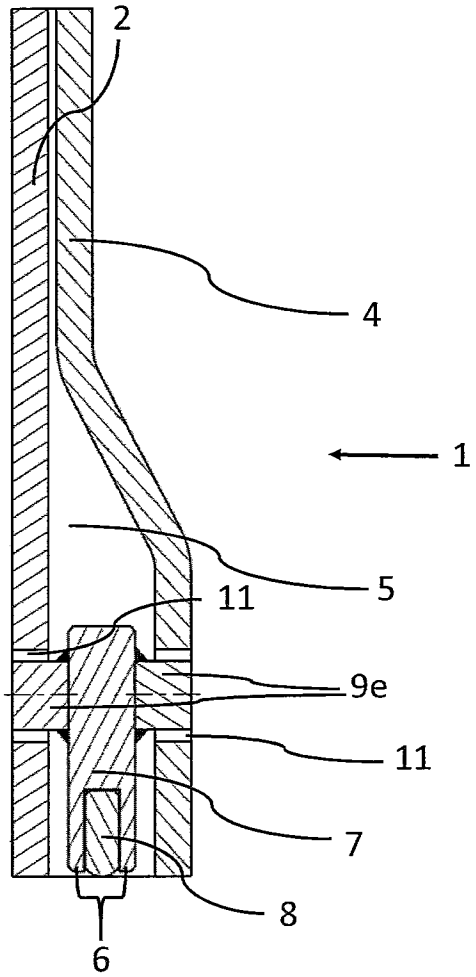
FIG. 6*b* shows schematically, a cross-section through the clearing strip from FIG. 6*a;*
Figure 6A:
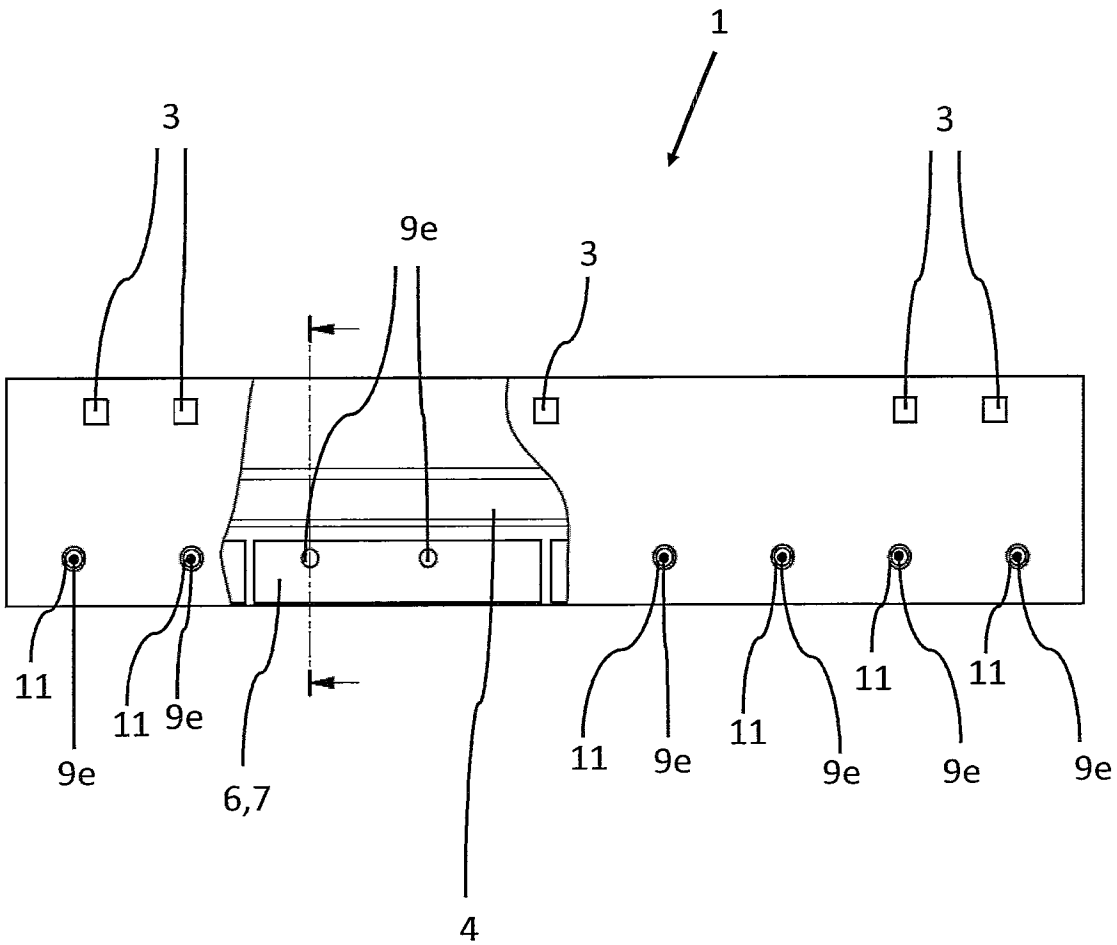
FIG. 6*a* shows schematically, the front view of a clearing strip according to the invention, using a sixth exemplary embodiment.

In FIG. 6*a/b*, the anchoring apparatus is represented by two bolts (9*e*), which are welded onto the hard-material body at their one end, and passed through bores 11 in the front and/or rear plate (2, 4) with play at their other end. In the case of this anchoring apparatus, as well, the hard-material body is remains movable in the rubber compound. It would also be conceivable if the bolts (9*e*) were welded onto the respective steel plate (2, 4) and passed through the hard-material body with play.

Figure 7B:
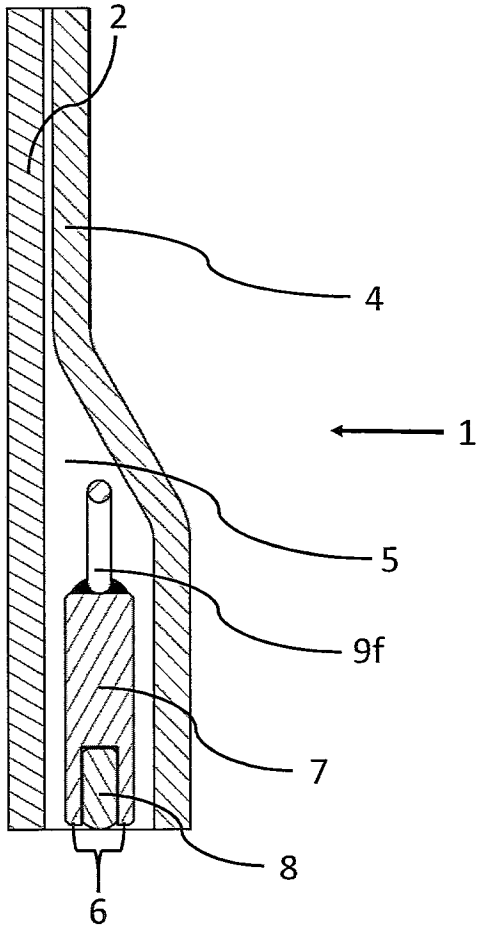
FIG. 7*b* shows schematically, a cross-section through the clearing strip from FIG. 7*a;*
Figure 7A:
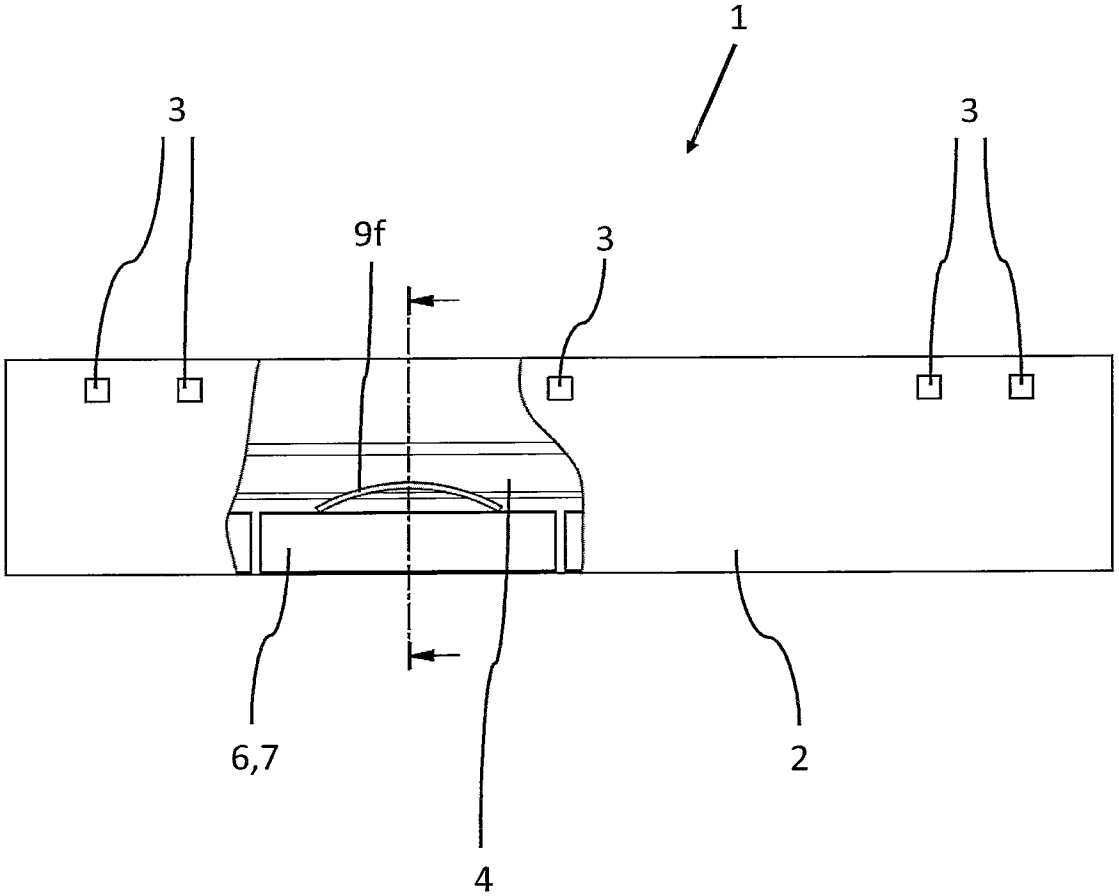
FIG. 7*a* shows schematically, the front view of a clearing strip according to the invention, using a seventh exemplary embodiment.
Figure 8B:
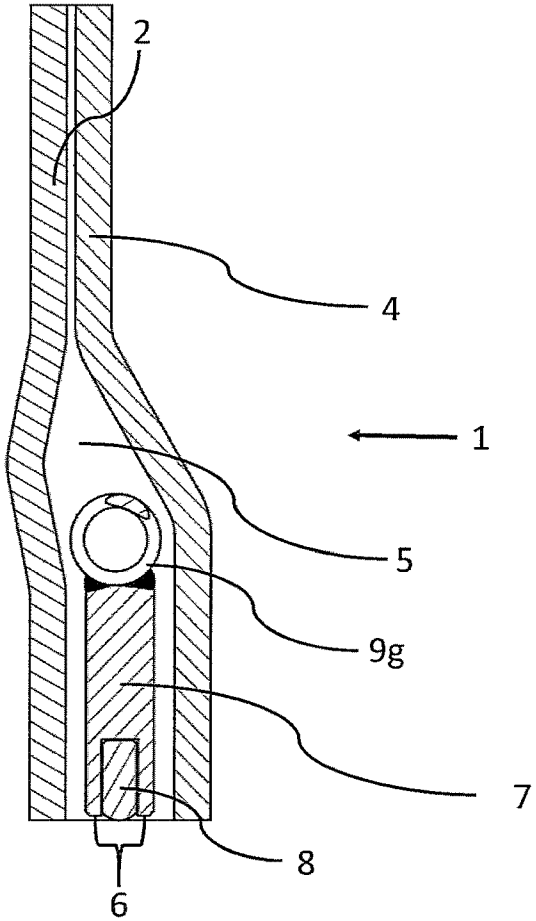
FIG. 8*b* shows schematically, a cross-section through the clearing strip from FIG. 7*a.*
Figure 8A:
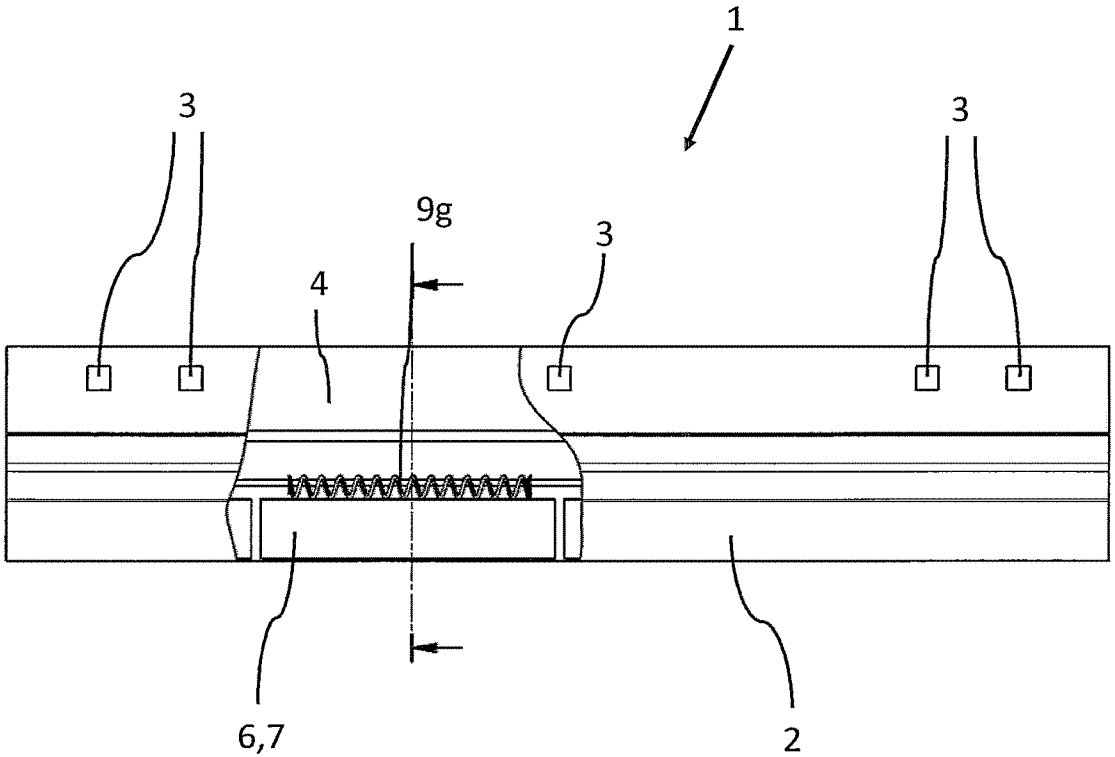
FIG. 8*a* shows schematically, the front view of a clearing strip according to the invention, using an eighth exemplary embodiment.

In FIG. 7*a/b* and FIG. 8*a/b*, embodiments are shown in which it is possible to do without a bore through the hard-material body 6, and the hard-material body 6 is nevertheless attached in the clearing strip in secure and movable manner. For this purpose, an anchoring element is welded on at the upper end of the hard-material body 6. It is important, in this regard, that the anchoring element is anchored well in the rubber layer 5. The shape of the anchoring element is decisive for this, so as to produce the best possible shape-fit and material-fit connection with the surrounding rubber layer 5. The hard-material body 6 is held in the clearing strip 1 in secure and movable manner by means of this anchoring element.

As an example, the anchoring element is shown in FIG. 6*a/b* in the form of a bracket 9*f*. In FIG. 7*a/b*, the anchoring element has a horizontal helical spring 9*g*. However, other forms of the anchoring element, not shown, are also possible, for example a vertical helical spring.

Although only a few embodiments of the present invention have been shown and described, it is to be understood that many changes and modifications may be made thereunto without departing from the spirit and scope of the invention.

REFERENCE SYMBOL LIST

1 clearing strip
2 front steel plate
3 bore
4 rear steel plate
5 rubber layer
6 hard-material body
7 steel mantle
8 tungsten carbide core
9*a* woven aramid tape
9*b* steel strip
9*c* wire cable
9*d* bent hook
9*e* bolt
9*f* bracket
9*g* helical spring
10 bore

What is claimed is:

1. A clearing strip (1) for the clearing shield of a snow plow, which strip has a front steel plate (2) and a rear steel plate (4), between which an elastic rubber layer (5) having at least one hard-material body (6) embedded into the rubber compound is vulcanized in, wherein the hard-material body (6) is movable relative to the steel plates (2, 4), with elastic deformation of the rubber compound, wherein each individual hard-material body (6) is anchored in the interior of the clearing strip (1) by means of an additional anchoring apparatus, wherein this additional anchoring apparatus does not restrict the movability of the hard-material bodies (6) relative to the steel plates (2, 4), wherein the anchoring apparatus has at least one anchoring element that is passed through the hard-material body (6), and wherein the anchoring apparatus has at least one bolt (9*e*), which is attached with play through the hard-material body (6) and rigidly on the rear and/or front steel plate (2, 4).

2. The clearing strip (1) according to claim 1, wherein the anchoring apparatus comprises a heat-resistant material.

* * * * *